US005839410A

United States Patent [19]

Suzuki et al.

[11] Patent Number: 5,839,410

[45] Date of Patent: Nov. 24, 1998

[54] IDLING CONTROL APPARATUS OF INTERNAL CONTROL ENGINE

[75] Inventors: Norio Suzuki; Kojiro Tsutsumi, both of Wako, Japan

[73] Assignee: Honda Giken Kogyo Kabushiki Kaisha, Tokyo, Japan

[21] Appl. No.: 856,689

[22] Filed: May 15, 1997

[30] Foreign Application Priority Data

May 17, 1996 [JP] Japan ..... 8-123146

[51] Int. Cl.[6] ..... F02D 41/08

[52] U.S. Cl. ..... 123/339.12; 123/339.23; 123/339.26

[58] Field of Search ..... 123/339.12, 339.19, 123/339.23, 339.25, 339.26

[56] References Cited

U.S. PATENT DOCUMENTS 4,644,921 2/1987 Kobayashi et al. ..... 123/689
5,463,993 11/1995 Livshits et al. ..... 123/339.11 X

FOREIGN PATENT DOCUMENTS 61-79839 4/1986 Japan ..... 123/339.12
8-232707 9/1996 Japan .

*Primary Examiner*—Tony M. Argenbright
*Attorney, Agent, or Firm*—Armstrong, Westerman, Hattori, McLeland, & Naughton

[57] ABSTRACT

An idling control apparatus of an internal combustion engine which undergoes an after-start lean-burn control for operating the internal combustion engine at an air-fuel ratio on a lean side of a theoretical air-fuel ratio after the engine started. According to the apparatus, the engine rotational speed under the after-start lean-burn control at a low temperature is stabilized, fluctuation of the engine rotational speed at a time when a lean-burn control is canceled is restrained, and a smooth idling state is realized. The apparatus includes an idling engine rotational speed controller which calculates a control amount for controlling the engine rotational speed on idling to a target engine rotational speed and carries out a feedback control by the calculated control amount, an after-start lean-burn control discriminator for discriminating whether the after-start lean-burn control is carried out after starting of the engine or not, and a corrector which calculates a correction amount for correcting the control amount of the idling engine rotational speed controller in accordance with a result of discrimination of the after-start lean-burn control discriminator. The idling engine rotational speed is controlled by the control amount corrected by the corrector.

6 Claims, 6 Drawing Sheets

IDLING CONTROL APPARATUS OF INTERNAL CONTROL ENGINE

BACKGROUND OF THE INVENTION

The present invention relates to an idling control apparatus of an internal combustion engine which undergoes an after-start lean-burn control for operating the internal combustion engine at an air-fuel ratio on a lean side of a theoretical air-fuel ratio immediately after the internal combustion engine started.

In a duration immediately after start of the internal combustion engine, particularly when it is cold, the combustion efficiency is low and a large quantity of HC is apt to occur in non-burnt gas. Therefore, as a countermeasure, the after-start lean-burn control, which controls the air-fuel ratio to the lean side (about 18 to 22 in contrast to the common stoichiometric air-fuel ratio of 14.7) to reduce amount of the non-burnt gas and restrain occurrence of HC as a result, is adopted.

Japanese patent publication No. Hei 5-31646 discloses an after-start lean-burn control in which an engine is operated with an air-fuel ratio controlled to be a lean side until a feedback control of the air-fuel ratio is commenced.

However, the after-start lean-burn control can not always be carried out in any state of operation after start of the internal combustion engine. If the lean-burn control is carried out when a cooling water temperature of the internal combustion engine is low to an extent that fuel atomization is hindered or high to an extent that percolation is anticipated, problems such as lowering of stability of engine rotation or engine stall occur. Accordingly, a method in which the lean-burn control is canceled under a certain operation condition has been proposed (Japanese laid-open patent publication No. Hei 8-232707).

Further, even if the cooling water temperature is not so low that it influences the fuel atomization, in a engine operation under the lean-burn control at a relatively low temperature, the combustion is not always stabilized and fluctuation of the engine rotational speed tends to be magnified.

Since carrying out and canceling of the after-start lean-burn control are changed over judging from engine operation condition, difference of engine output torques at the lean-burn control and at non lean-burn control appears largely at the changeover. Accordingly there are problems such that the engine rotational speed or the like is influenced to magnify fluctuation of the engine rotation or a correction amount of the suction air amount based on fluctuation of an electric load of an air conditioner becomes impertinent.

SUMMARY OF THE INVENTION

The present invention has been accomplished in view of the foregoing and an object of the invention is to provide an idling control apparatus of an internal combustion engine capable of stabilizing the engine rotational speed under the after-start lean-burn control after the engine started at a low temperature, restraining fluctuation of the engine rotational speed when the after-start lean-burn control is canceled and realizing a smooth idling state.

FIG. 1 is a view showing conceptually a constitution of the idling control apparatus of the internal combustion engine according to the present invention.

The idling engine rotational speed control means A calculates a control amount a for controlling the engine rotational speed on idling to a target engine rotational speed and carries out a feedback control by the control amount a.

An after-start lean-burn control discriminating means B discriminates whether the after-start lean-burn control is carried out after starting of the internal combustion engine or not, and a correcting means C calculates a correction amount k for correcting the control amount a of the idling engine rotational speed control means A in accordance with a result of discrimination of the after-start lean-burn control discriminating means B.

The idling engine rotational speed is controlled by the control amount b corrected by the correction amount k.

Since the correcting means calculates the correction amount k for correcting the control amount a of the idling engine rotational speed control means A in accordance with the result of discrimination of the after-start lean-burn control discriminating means B (whether the lean-burn control is carried out or not) and the idling engine rotational speed is controlled by the corrected control amount b, controls of the idling engine rotational speed in accordance with carrying out or canceling of the lean-burn control are possible, stabilization of the engine rotational speed in the after-start lean-burn control at a low temperature can be attempted, fluctuation of the engine rotational speed when the lean-burn control is canceled can be prevented and a smooth idling state can be realized always.

The idling engine rotational speed control means may be throttle control means for driving a throttle valve in an intake system of the internal combustion engine to regulate a suction air amount or bypass air control means for regulating an air amount passing through a bypass passage in an intake system, and the correcting means may correct a target suction air amount on idling. According to this constitution, the target suction air amount on idling is corrected in accordance with whether the lean-burn control is carried out or not so that a smooth idling state can be realized.

If the control amount is corrected so as to increase by the correction amount, it is possible to set the idling rotational speed somewhat higher than a common target value while making the air-fuel ratio lean so that stabilization of the engine rotational speed at a low temperature can be attempted and a smooth idling state can be realized.

DETAILED DESCRIPTION OF THE PREFERRED EMBODIMENT

Figure 1:
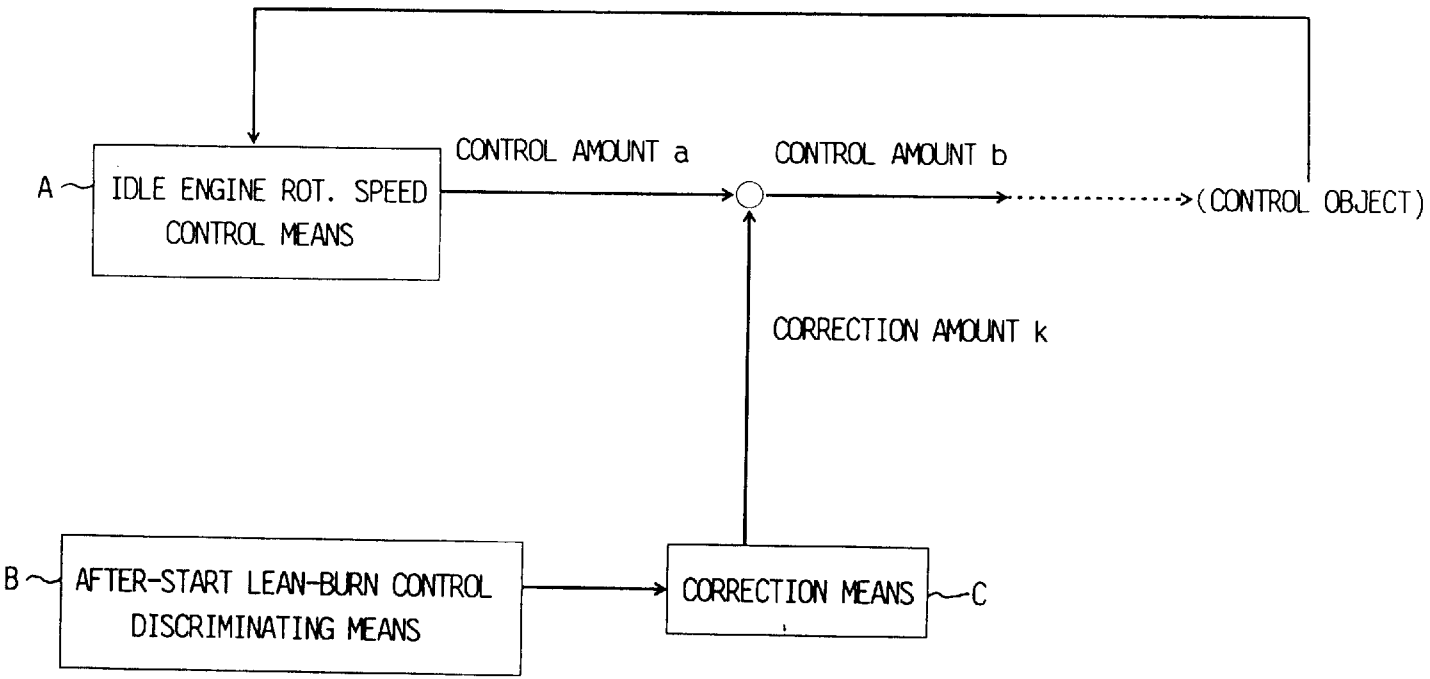
FIG. 1 is a view showing conceptually a constitution of the idling control apparatus of the internal combustion engine according to the present invention.
Figure 2:
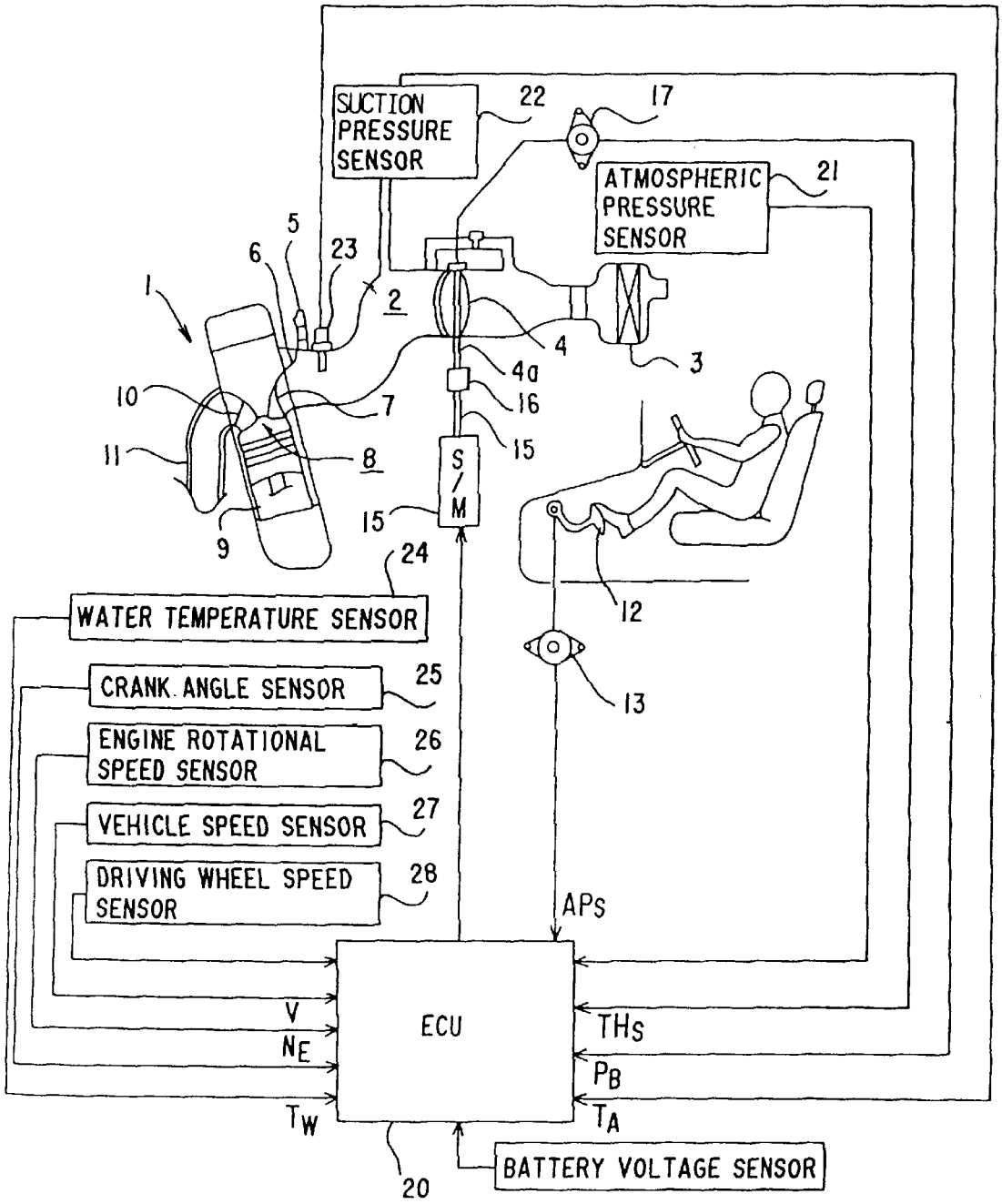
FIG. 2 is a rough view showing an entire fuel supply control apparatus of an internal combustion engine according to one embodiment of the present invention.

Hereinafter, an embodiment of the present invention will be described with reference to FIGS. 2 to 6. In this embodiment, the present invention is applied to an internal combustion engine to be mounted in a vehicle and FIG. 2 is a rough view showing an entire fuel supply control apparatus of the internal combustion engine.

An intake passage 2 for supplying fuel to the internal combustion engine 1 is provided with an air cleaner 3 at an upper stream end, a throttle valve 4 for opening and closing the intake passage 2 at a middle way and a fuel injection valve 5 on a lower stream side. Air introduced in the intake passage 2 through the air cleaner 3 is regulated with respect to the flow rate by the throttle valve 4, enters an intake manifold 6 and then flows into a combustion chamber 8 together with fuel injected from the fuel injection valve 5 through an intake port 7 opened and closed by an intake valve.

The mixture thus introduced in the combustion chamber burns to drive a piston 9, then discharges out of the engine through an exhaust port 10 opened and closed by an exhaust valve, an exhaust manifold 11 and an exhaust passage.

On a floor of a driving room of a vehicle having the internal combustion engine 1 mounted is arranged an accelerator pedal 12 which is forced to an idle position by a spring and rocks in accordance with a pressing down motion of a driver.

As shown in FIG. 2, the accelerator pedal 12 and the throttle valve 4 are not connected mechanically with each other. The pressed amount of the accelerator pedal 12 is detected by an accelerator sensor 13 composed of a potentiometer provided on a rocking shaft of the accelerator pedal 12, the throttle valve 4 is driven to open and close by a step motor 15, and the step motor 15 is operated by a driving signal from an electronic control unit ECU 20.

A driving shaft 15*a* of the step motor 15 and a valve shaft 4*a* of the throttle valve 4 are coaxial and directly connected with each other through a connecting portion 16 without any variable-speed connecting device such as a gear. An angle of rotation in normal or reverse direction of the step motor 15 is nothing but an angle of opening or closing of the throttle valve 4. The opening or closing angle of the throttle valve 4 is detected by a throttle sensor 17 composed of a potentiometer or the like and the detection signal is inputted to ECU 20.

An atmospheric pressure sensor 21 is arranged on the upper stream side of the intake passage 2, a suction pressure sensor 22 is provided on the lower stream side of the throttle valve 4 to detect an absolute pressure of the suction air, and on further lower stream side is provided a suction air temperature sensor 23 for detecting a temperature of the suction air.

In the neighborhood of the combustion chamber 8 of the internal combustion engine 1 is provided a water temperature sensor 24 for detecting a temperature of the cooling water, and within a distributor is provided a crank angle sensor 25. In addition, an engine rotational speed sensor 26, a vehicle speed sensor 27 and a driving wheel speed sensor 28 are provided on suitable positions. Detection signals of the above sensors are inputted to ECU 20.

Other detection signals from various sensors such as a battery voltage sensor 29 for detecting a battery voltage are also inputted to ECU 20. The step motor 15 is a hybrid type 4 phases stepping motor and driven by phase exciting drive mode.

Figure 3:
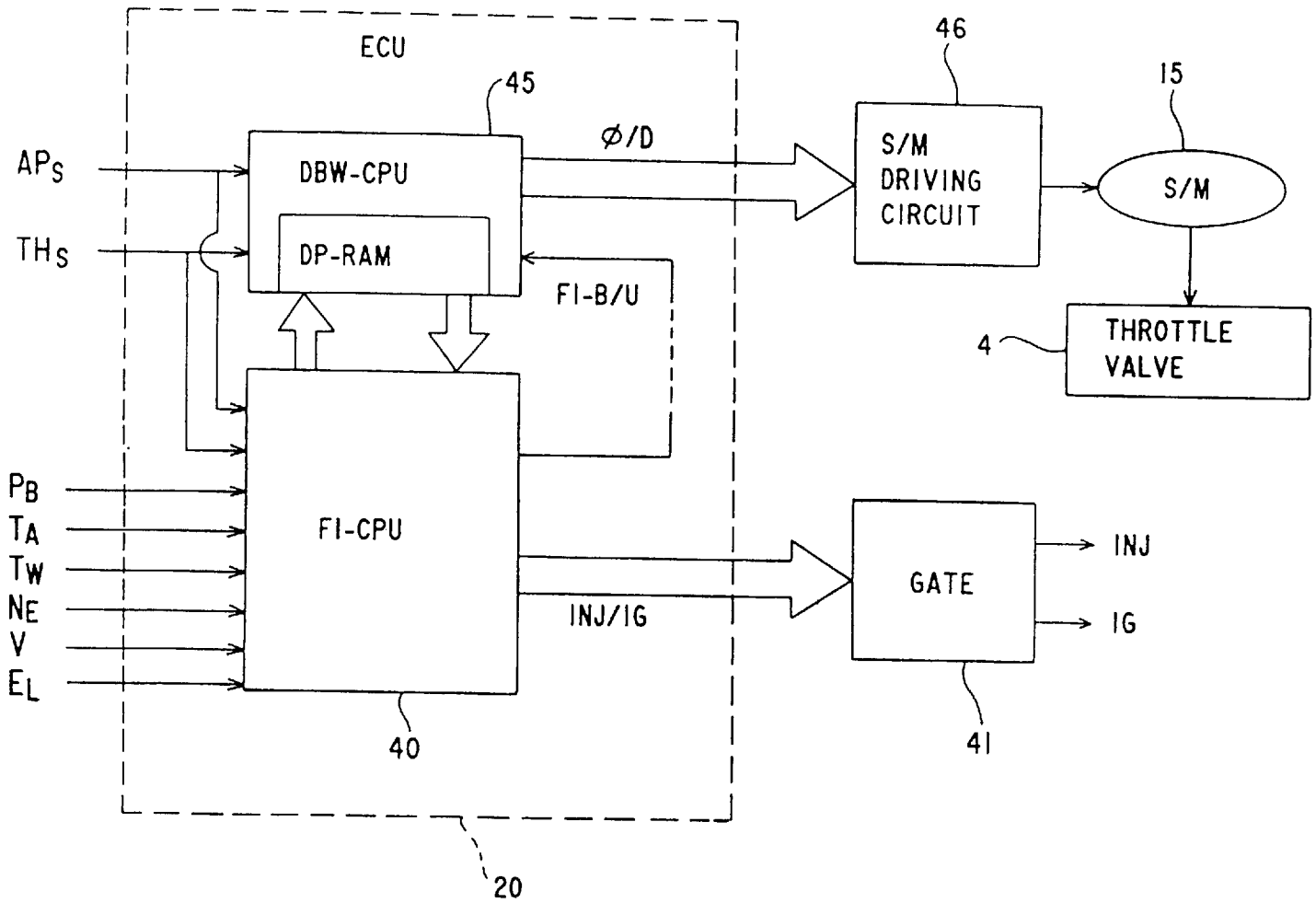
FIG. 3 is a rough block diagram showing a control system of the fuel supply control apparatus.

FIG. 3 is a rough block diagram showing the control system. Within the ECU 20, the fuel supply control is carried out by FI-CPU 40 which is inputted with detection signals from the above-mentioned various sensors detecting operation states of the internal combustion engine such as intake pipe absolute pressure $P_B$, suction air temperature TA engine cooling water temperature TW engine rotational speed $N_E$, vehicle speed V, accelerator pedal angle $AP_S$, from the accelerator sensor 13, and throttle valve opening degree $TH_S$ from the throttle sensor 17 for example, and outputs INJ signal for controlling the fuel injection valve 5 based on the operation state and IG signal for controlling the ignition time through a gate 41.

For example, ECU 20 decides a fuel injection amount (usually, a fuel injection time) on the basis of output signals of the above-mentioned various sensors in accordance with the following formula.

$$T_{OUT}=T_{REF}\times T_{TW}(\times T_{HAC}\times\ldots)\times K$$

where $T_{REF}$: a basic fuel injection time obtainable from operation states of the engine (load, $P_B$, engine rotational speed etc.)

$T_{TW}$: a correction coefficient determined by the water temperature $T_{HAC}$: a correction coefficient determined by electric load etc.

K: air-fuel ratio correction coefficient

Any other coefficient determined by the suction air temperature etc. can be used.

K is a correction coefficient for controlling the air-fuel ratio to the lean side. In a duration immediately after start of the engine, particularly when it is cold, the combustion efficiency is low and a large quantity of HC is apt to occur in non-burnt gas, therefore the air-fuel ratio is controlled to the lean side to reduce amount of non-burnt gas and restrain occurrence of HC as a result. When the air-fuel ratio is to be the stoichiometric ratio, K is set at 1.0.

The opening degree control of the throttle valve 4 through the step motor 15 is carried out by DBW-CPU 45. The accelerator pedal angle signal $AP_S$ and the throttle valve opening degree signal $TH_S$ detected by the accelerator sensor 13 and the throttle sensor 17 respectively are inputted into the DBW-CPU 45, an exciting phase signal $\phi$ and a duty signal D for driving the step motor 5 is outputted from the DBW-CPU 45 to a step motor drive circuit 46, and the step motor 15 is driven by the step motor drive circuit 46.

The detection signal of the accelerator sensor 13 and the throttle sensor 17 are also inputted to FI-CPU 40 in addition to the signals from sensors detecting states of operation to calculate a target throttle opening degree based on the detection signals. These informations are transmitted to DBW-CPU 45 through DP-RAM 42 which manages give-and-take of signals between FI-CPU 40 and DBW-CPU 45.

DBW-CPU 45 determines a final target throttle opening degree $TH_O$ on the basis of these informations through various corrections on the way, and sets and outputs the above-mentioned exciting phase $\phi$ and duty D of the electric current supplied to the step motor 15 to make the throttle opening degree of the throttle valve 4 coincide with the final target throttle opening degree $TH_O$.

In case of some operation states or abnormal states, FI-CPU 40 can perform a role of back up intervening in DP-RAM 41. At this time, transmitting and receiving of signals by DP-RAM 42 are stopped.

The final target throttle opening degree $TH_O$ is calculated by adding an idle throttle opening degree $TH_{IDL}$ to the target throttle opening degree $TH_{NML}$ which is calculated mainly on the basis of the accelerator pedal angle $AP_S$ detected by the accelerator sensor 13, as shown by the following formula (1)

$$TH_O = TH_{NML} + TH_{IDL} \quad (1)$$

The idle throttle opening degree $TH_{IDL}$ in the formula (1) corresponds to a final target throttle opening degree $TH_O$ in an idle state ($TH_{NML}=0$) that the accelerator pedal 12 is not pressed generally. When the accelerator pedal 12 is pressed, the throttle valve 4 starts to open from the idle throttle opening degree $TH_{IDL}$.

The target throttle opening degree $TH_{NML}$ is determined in accordance with the accelerator pedal angle $AP_S$ and obtained by retrieving a map set beforehand.

Figure 5:
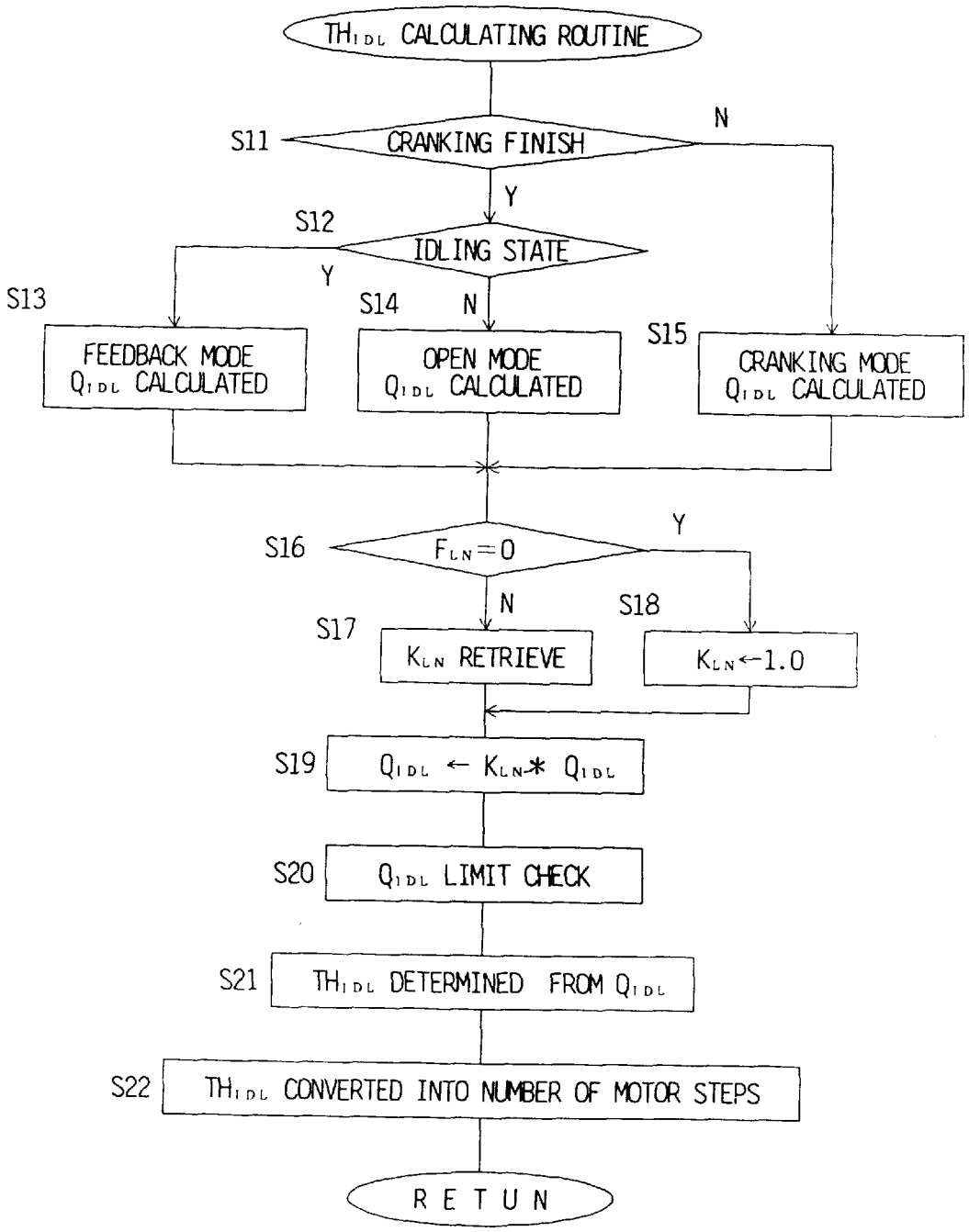
FIG. 5 is a flow chart showing an operation procedure for determining an idle target throttle opening degree $TH_{IDL}$.

The retrieved target throttle opening degree $TH_{NML}$ is not used directly for driving the throttle valve 4, but further corrected in accordance with the flow chart of FIG. 5 to obtain a decisive value of the target throttle opening degree $TH_{NML}$. The final target throttle opening degree is set by adding the idle throttle opening degree $TH_{IDL}$ to the above decisive value.

Figure 4:
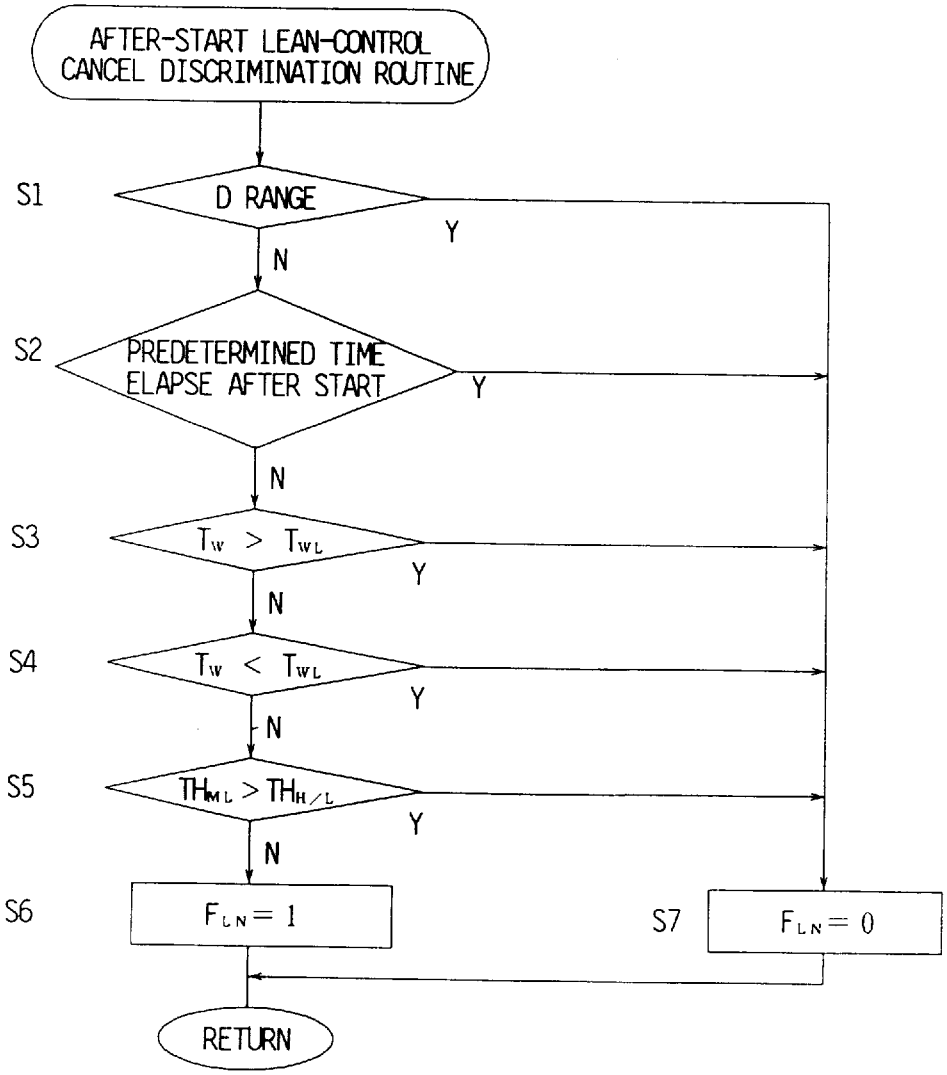
FIG. 4 is a flow chart showing an operation procedure for discriminating cancellation of an after-start lean-burn control.

Since the determination of the idle throttle opening degree $TH_{IDL}$ which is a target throttle opening degree $TH_{NML}$ in an idle state is influenced by whether the after-start lean-burn control is carried out or not, at first, an operation procedure for discriminating cancellation of the after-start lean-burn control will be described with reference to the flow chart of FIG. 4.

At Step 1, whether a shift gear of a vehicle is in D-range, which is a normal running mode, or not is discriminated. When the shift gear is in a range other than D-range, the flow advances to Step 2. When the shift gear is in D-range, the flow jumps to Step 7 for setting a after-start lean flag $F_{LN}$ to "0" and instructing cancellation of the after-start lean-burn control.

At Step 2, whether a predetermined time during which lean-burn control immediately after starting is to be carried out elapsed or not is discriminated. The flow advances to Step 3 when the time does not elapse, or jumps to Step 7 when the time elapsed, for setting the after-start lean flag $F_{LN}$ to "0" and instructing cancellation of the after-start lean-burn control.

When the flow advances to Step 3, whether cooling water temperature $T_{WL}$ of the internal combustion engine is within a temperature range ($T_{WL} \leqq T_W \leqq T_{WH}$) adapted for the after-start lean-burn control with no difficulty or not is discriminated in Steps 3, 4. When the cooling water temperature is within the temperature range, the flow advances to Step 5 and when out of the temperature range, jumps to Step 7 to set the after-start lean flag $F_{LN}$ to "0". The lower limit temperature $T_{WL}$ is a low temperature below which a trouble can be caused in fuel atomization, and the upper limit temperature $T_{WH}$ is a high temperature above which percolation is anticipated.

At Step 5, whether the target throttle opening degree $TH_{NML}$ is lower than an idle discriminating threshold value $TH_{H/L}$ or not is discriminated. The value $TH_{H/L}$ has a hysteresis and driver's intention of running can be discriminated by it. When $TH_{NML}$ is lower than the idle discriminating threshold value $TH_{H/L}$, the flow advances to step 6 to set the after-start lean flag $F_{LN}$ to "1" and instruct after-start lean-burn control. When $TH_{NML}$ is higher than the value $TH_{H/L}$, the flow advances to Step 7 to set the after-start lean flag to "0".

Namely, only when conditions such that the shift range is not D-range, it is within a predetermined time after starting, cooling water temperature $T_W$ of the internal combustion engine is within a predetermined temperature range and the target throttle opening degree $TH_{NML}$ does not exceed a predetermined idle discriminating threshold value are all satisfied, the after-start lean-burn control is carried out with the after-start lean flag $F_{LN}$ set to "1". When any one of the above conditions is not satisfied, the after-start lean flag $F_{LN}$ is set to "0" to instruct cancellation of the after-start lean-burn control. Thus, carrying out or cancellation of the after-start lean-burn control is set on the basis of the after-start lean flag $F_{LN}$.

Next, a procedure for deciding the idle throttle opening degree $TH_{IDL}$ will be described with reference to the flow chart of FIG. 5.

At Step 11, whether cranking has been finished or not, that is whether the engine has been started by a starter motor or not, is discriminated. When the engine is in the course of cranking, the flow jumps to Step 15 to calculate a target suction air amount $Q_{IDL}$ in cranking mode. When the cranking has been finished, the flow advances to Step 12 and whether the engine is in an idling state or not is discriminated. If it is in the idling state, the flow advances to Step 13 and a target suction air amount $Q_{IDL}$ in a feedback mode is calculated. If it is not in the idling state, the flow advances to Step 14 and a target suction air amount $Q_{IDL}$ in an open mode is calculated.

The target suction air amount $Q_{IDL}$ in each mode is calculated in accordance with a state of external load in the corresponding mode, namely, the target suction air amounts $Q_{IDL}$ in the feedback mode of Step 13, the open mode of Step 14 and the cranking mode of Step 15 are calculated by the following formulas (2), (3) and (4), respectively.

$$Q_{IDL} = (Q_{FBN} + Q_{LOAD} + Q_{SA}) \times K_{PAD} + Q_{PA} \quad (2)$$

$$Q_{IDL} = (Q_{XREF} + Q_{TW} + Q_{LOAD} + Q_{SA}) \times K_{PAD} + Q_{DEC} + Q_{PA} \quad (3)$$

$$Q_{IDL} = (Q_{XREF} + Q_{CRST}) \times K_{PAD} + Q_{PA} \quad (4)$$

In the above formulas, $Q_{FBN}$ is a feedback suction air term for comparing a target idling rotational sped with an actual idling rotational speed, for example, and changing the control amount so that the both idling rotational speeds coincide with each other. $Q_{LOAD}$ is a electric load term, $Q_{SA}$ is a shot air term, $Q_{XREF}$ is a learning value of the feedback term, $Q_{TW}$ is a water temperature correction term, $Q_{CRST}$ is a starting water temperature correction term, $K_{PAD}$ is an atmospheric pressure correcting multiplication term, $Q_{PA}$ is an atmospheric pressure correcting addition term and $Q_{DEC}$ is a deceleration correcting addition term.

After calculation of the target suction air amount $Q_{IDL}$ at Steps 13, 14 or 15, the flow advances to Step 16 to discriminate whether the after-start lean flag $F_{LN}$ is "0" or "1". When the after-start lean-burn control is being carried out with the flag $F_{LN}$ set to "1", the flow advances to Step 17 to obtain a correction coefficient $K_{LN}$ by retrieval and further advances to Step 19. When the after-start lean-burn control is canceled with the flag $F_{LN}$ set to "0", the flow advances to Step 18 where the correction coefficient $K_{LN}$ is set to 1.0 then to step 19.

At Step 19, the target suction air amount $Q_{IDL}$ calculated at Step 13, 14 or 15 is multiplied by the correction coefficient $K_{LN}$ for correction. When the after-start lean-burn control is canceled, since $K_{LN}=1.0$ (STEP 18), the target suction air amount $Q_{IDL}$ is not corrected in effect and the target suction air amount $Q_{IDL}$ calculated at Step 13, 14 or 15 is used as it is.

Figure 6:
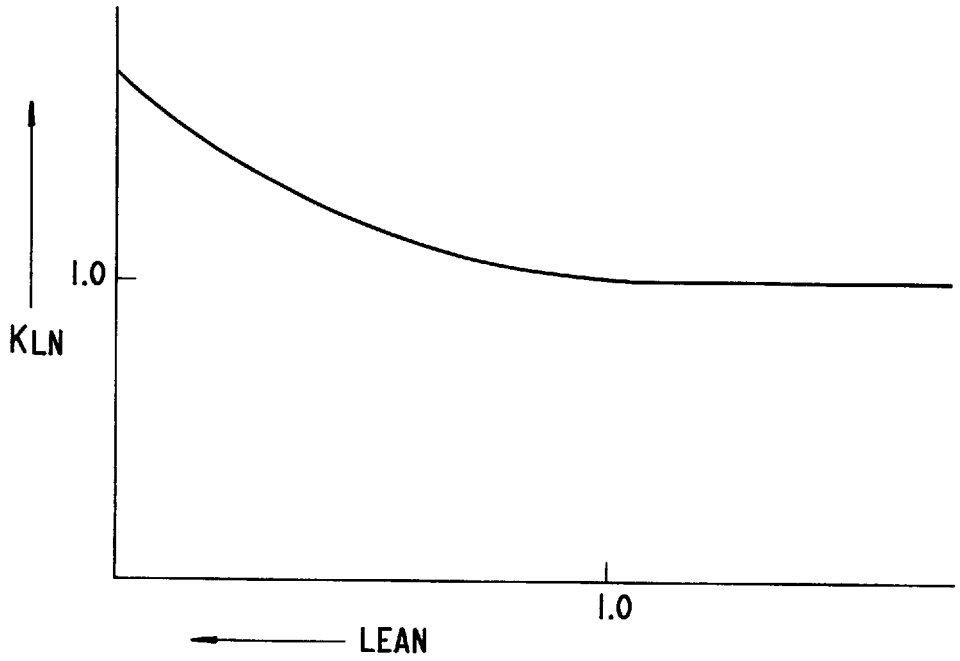
FIG. 6 is a graph for explaining a table for retrieving a correction coefficient $K_{LN}$ of a target suction air amount $Q_{IDL}$.

The retrieval of the correction coefficient $K_{LN}$ at Step 17 is carried out on the basis of state of lean of the mixture. FIG. 6 is a graph showing a relation between the state of lean and the correction coefficient $K_{LN}$. In the graph, the abscissa shows degree of lean which corresponds to the air-fuel ratio relative to the theoretical air-fuel ratio. The position of 1.0 corresponds to the theoretical air-fuel ratio and the degree of lean increases as the air-fuel ratio decreases. The ordinate shows the correction coefficient $K_{LN}$.

The relation between the state of lean and the correction coefficient $K_{LN}$ is determined beforehand so that the correction coefficient $K_{LN}$ is fixed to 1.0 in a region wherein the relative air-fuel ratio exceeds 1.0, and gradually increases from 1.0 as the state of lean increases.

In general, when the lean-burn control is carried out, the state of lean is below 1.0, therefore a correction coefficient $K_{LN}$ above 1.0 is retrieved and the target suction air amount $Q_{IDL}$ is corrected so as to increase.

When the after-start lean-burn control is canceled, $K_{LN}$ is set to 1.0 at Step 18. It almost agrees with that the correction coefficient $K_{LN}$ is fixed to 1.0 in the retrieval at Step 17 when the state of lean exceeds 1.0.

The target suction air amount $Q_{IDL}$ corrected in this way next undergoes a limit check at Step 20 and if the corrected target suction air amount $Q_{IDL}$ exceeds a limit value, the limit value is used as the target suction air amount $Q_{IDL}$.

At Step 21, the idle throttle opening degree $TH_{IDL}$ is retrieved from a table on the basis of the target suction air amount $Q_{IDL}$, then at Step 22, the retrieved idle throttle opening degree $TH_{IDL}$ is converted into number of steps of the motor.

The idle throttle opening degree $TH_{IDL}$ calculated in the manner as described above is added to the first target throttle opening degree $TH_{NML}$ calculated mainly based on the accelerator pedal angle $AP_S$ as shown by the aforementioned formula (1) to obtain the final target throttle opening degree $TH_O$ and the throttle valve 4 is driven to realize the final target throttle opening degree $TH_O$.

Under the after-start lean-burn control, the target suction air amount $Q_{IDL}$ is corrected in accordance with degree of lean, therefore, even if the water temperature $T_W$ is low, for example 10° C., the combustion can be stabilized to prevent fluctuation of the engine rotational speed. It is to be noted that the lower limit temperature $T_{WL}$ at Step 4 in the flow chart of FIG. 4 for discriminating whether the after-start lean-burn control is carried out or not is a further lower temperature.

Since correction amount of the target suction air amount $Q_{IDL}$ is changed in accordance with whether the after-start lean-burn control is carried out or not and the idle throttle opening degree $TH_{IDL}$ can be set properly in accordance with degree of lean, the idle throttle opening degree $TH_{IDL}$ at the time when the after-start lean-burn control is canceled can be maintained properly to restrain fluctuation of the output torque and prevent fluctuation of the engine rotational speed.

For example, even when the accelerator pedal is pressed down and the after-start lean-burn control is canceled, fluctuation of the engine rotational speed can be prevented. The above-mentioned electric load term $Q_{LOAD}$ which is a correction amount regarding load such as air-conditioner is set at different values before and after cancellation of the after-start lean-burn control. These values also can be prevented from becoming impertinent because of fluctuation of the engine torque by suction amount. Thus, a smooth idle operation state can be realized always.

In the above-mentioned embodiment, the idle throttle opening degree $TH_{IDL}$ is controlled by correcting the target suction air amount $Q_{IDL}$, however, ignition time may be corrected for controlling. Namely, by correcting the ignition time in accordance with whether the after-start lean-burn control is carried out or not, it is possible to maintain a stable combustion always and prevent fluctuation of the engine rotational speed.

In an engine having a bypass air control system with a bypass passage in an intake system, the idle engine rotational speed may be controlled by adjusting amount of the bypass air.

What is claimed is:

1. An idling control apparatus of an internal combustion engine which undergoes an after-start lean-burn control for operating said internal combustion engine at an air-fuel ratio on a lean side of a theoretical air-fuel ratio after said internal combustion engine started, comprising:

an idling engine rotational speed control means which calculates a control amount for controlling the engine rotational speed on idling to a target engine rotational speed and carries out a feedback control by said calculated control amount;

an after-start lean-burn control discriminating means for determining whether said after-start lean-burn control is carried out after starting of said internal combustion engine; and a correcting means which calculates a correction amount for correcting said control amount calculated by said idling engine rotational speed control means based on a result of the determination by said after-start lean-burn control discrimination means, wherein the idling engine rotational speed is controlled by said control amount corrected by said correcting means.

2. An idling control apparatus of an internal combustion engine as claimed in claim 1, wherein said idling engine rotational speed control means is a throttle control means for driving a throttle valve in an intake system of said internal combustion engine to regulate a suction air amount, and said correcting means corrects a target suction air amount on idling.

3. An idling control apparatus of an internal combustion engine as claimed in claim 1, wherein said idling engine rotational speed control means is a bypass air control means for regulating an air amount passing through a bypass passage in an intake system, and said correcting means corrects a target suction air amount on idling.

4. An idling control apparatus of an internal combustion engine as claimed in claim 1, 2, or 3, wherein said correcting means calculates a correction amount for correcting said control amount so as to increase.

5. An idling control apparatus according to claim 1, wherein said correcting means calculates the correction amount when said after-start lean-burn control discriminating means determines that the after-start lean-burn control is cancelled.

6. An idling control apparatus according to claim 1, wherein said correcting means calculates the correction amount when said after-start lean-burn control discriminating means determines a changeover from an application of the after-start lean-burn control to a cancellation of the after-start lean-burn control.

* * * * *